US005711690A

United States Patent [19]

Thrush et al.

[11] Patent Number: 5,711,690

[45] Date of Patent: Jan. 27, 1998

[54] ELECTRICAL CONTACT AND METHOD FOR MAKING SAME

[75] Inventors: Roger Lee Thrush, Clemmons, N.C.; Timothy James Kinross, Taylors, S.C.

[73] Assignee: The Whitaker Corporation, Wilmington, Del.

[21] Appl. No.: 733,836

[22] Filed: Oct. 18, 1996

[51] Int. Cl.[6] ..... H01R 11/22

[52] U.S. Cl. ..... 439/862; 439/636; 29/874

[58] Field of Search ..... 439/856, 862, 439/858, 636, 326, 60, 633, 634, 635, 637, 630; 29/874

[56] References Cited

U.S. PATENT DOCUMENTS 3,555,493 1/1971 Baumanis ..... 439/636

4,557,548 12/1985 Thrush ..... 339/258 P 5,082,459 1/1992 Billman et al. ..... 439/637

5,480,316 1/1996 Kinross et al. ..... 439/326

*Primary Examiner*—Gary F. Paumen

*Assistant Examiner*—Tho D. Ta

*Attorney, Agent, or Firm*—Robert J. Kapalka

[57] ABSTRACT

An electrical contact comprises an electrically conductive body which is made from sheet material. The body has opposite major surfaces and a peripheral edge defined by a thickness of the sheet material. The body has first and second arms each with a contact surface arranged to engage a respective opposite side of a circuit card which is inserted between the arms. The contact surface of the first arm is defined on the peripheral edge of the body, and the contact surface of the second arm is defined on one of the major surfaces of the body.

7 Claims, 3 Drawing Sheets

ELECTRICAL CONTACT AND METHOD FOR MAKING SAME

FIELD OF THE INVENTION

The invention relates to an electrical contact having a pair of contact arms which are arranged to engage respective opposite sides of a circuit card which is inserted between the arms.

BACKGROUND OF THE INVENTION

U.S. Pat. No. 4,557,548 discloses a card edge electrical connector having contacts which are stamped and formed from sheet material. The contacts are made by stamping the sheet to remove selected portions of material, and then bending the sheet to produce desired configurations of contacts attached to a carrier strip. Each of the contacts has a pair of arms which are bent out of a plane of the carrier strip and are arranged in an opposing relationship to engage respective opposite sides of a circuit card which is inserted between the arms. The contacts are spaced along the carrier strip at a distance, or pitch, which is the same as the pitch between adjacent contacts after they have been installed in the connector housing. The contacts remain attached to the carrier strip until they are at least partially inserted into the connector housing. This permits the contacts to be gang loaded into the housing, that is, a plurality of contacts which are attached to the carrier strip can be simultaneously inserted into the housing with a single stroke of insertion equipment. The carrier strip is severed from the contacts as an accompanying step of the insertion operation. These stamped and formed contacts present problems in that the contacts are somewhat difficult to stamp, forming operations add expense, and a relatively large amount of material scrap is produced.

Blanked contacts overcome the drawbacks associated with stamped and formed contacts. U.S. Pat. No. 5,082,459 discloses a card edge electrical connector having blanked contacts. These are made by stamping sheet material to remove material around a profile which defines a final configuration for each contact. These contacts do not require a forming operation because they make electrical engagement with a circuit card along their stamped edges. The blanked contacts are attached to a carrier strip, but since the contacts are all in a plane of the carrier strip the contacts cannot be gang loaded into the connector housing. With blanked contacts only contacts which are located on a same centerline in the housing can be installed simultaneously into the housing. Therefore, multiple insertion strokes are required to install a full complement of contacts into an elongated card edge connector housing. The housing must be moved in successive steps to bring successive cavities of the housing into a contact insertion station, and the carrier strip must be moved in successive steps to bring successive contacts into registration with the successive cavities. These multiple steps are time consuming, thereby slowing production rates.

There is a need for electrical contacts which can be gang-loaded into a connector housing but which are more simple and economical to produce than prior art contacts.

SUMMARY OF THE INVENTION

An electrical contact comprises an electrically conductive body which is made from sheet material. The body has opposite major surfaces and a peripheral edge defined by a thickness of the sheet material. The body has first and second arms each with a contact surface arranged to engage a respective opposite side of a circuit card which is inserted between the arms. The contact surface of the first arm is defined on the peripheral edge of the body, and the contact surface of the second arm is defined on one of the major surfaces of the body.

BRIEF DESCRIPTION OF THE DRAWINGS

The invention will now be described by way of example with reference to the accompanying drawings wherein.

DETAILED DESCRIPTION OF THE PREFERRED EMBODIMENT

Figure 1:
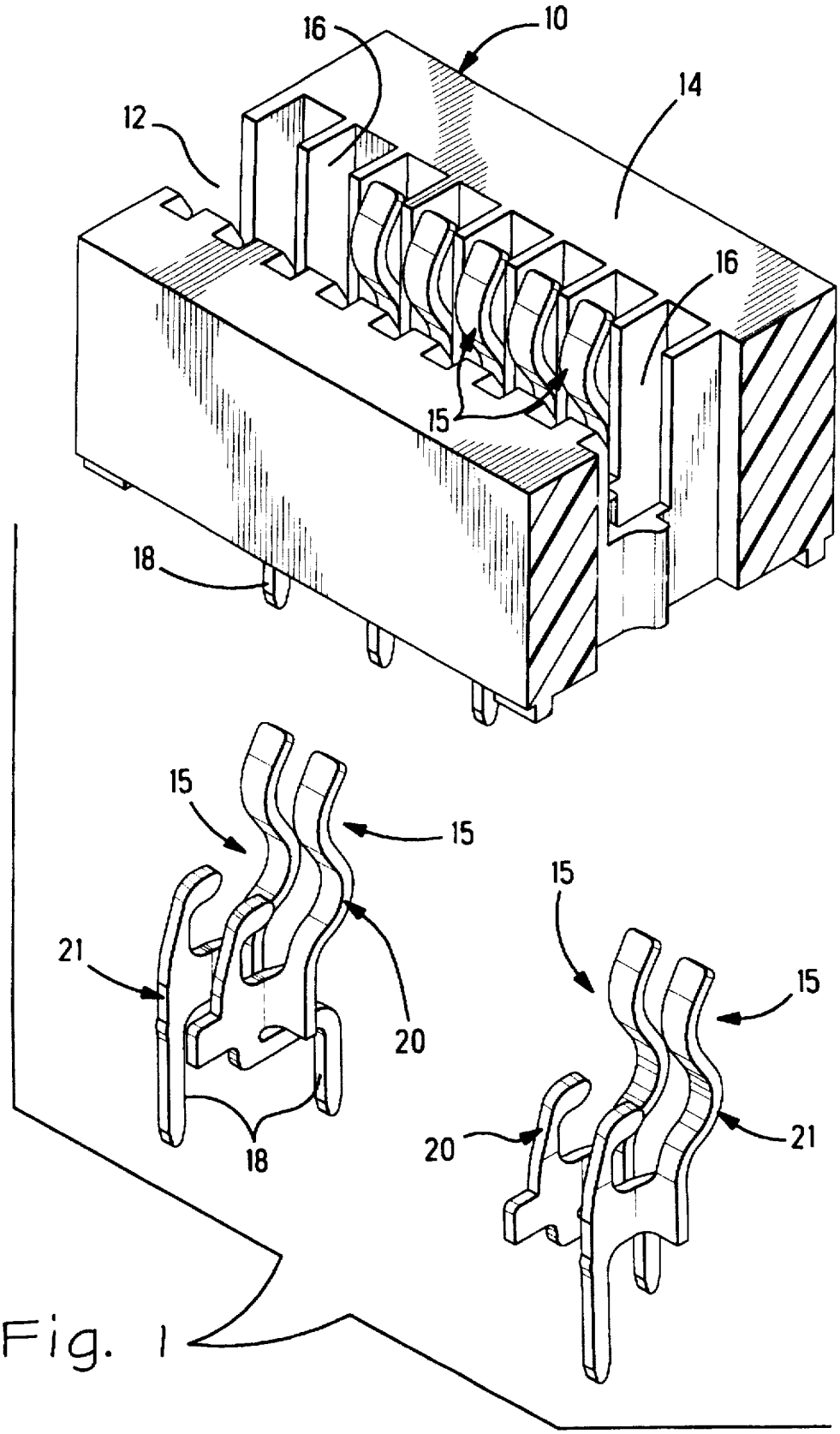
FIG. 1 is an isometric view of a portion of an electrical connector having contacts according to the invention.

There is shown in FIG. 1 a portion of a card edge electrical connector which has contacts constructed according to the invention. The connector comprises a dielectric housing 10 having an elongated slot 12 which is open through a top surface 14 of the housing for receiving an edge portion of a circuit card such as a single in-line memory module (SIMM) daughtercard (not shown). The housing carries a plurality of contacts 15 which are installed into respective cavities 16 through a bottom of the housing 10. The contacts 15 are arranged along a length of the slot 12 for electrically connecting with associated circuit paths on the daughtercard. The contacts have respective solder tail leads 18 which extend exteriorly of the housing for connection to circuit paths on a motherboard (not shown). Although not required, the solder tail leads 18 are shown alternately staggered on opposite sides of a longitudinal axis of the connector, thereby increasing the distance between the leads of adjacent contacts. This requires that the contacts 15 be produced in two sets, with one set comprising contact bodies 20 and the other set comprising contact bodies 21. However, each of these sets can be produced by the same method according to the invention, and for simplification, only the set having the contact bodies 20 will be illustrated and described in detail.

Figure 2:
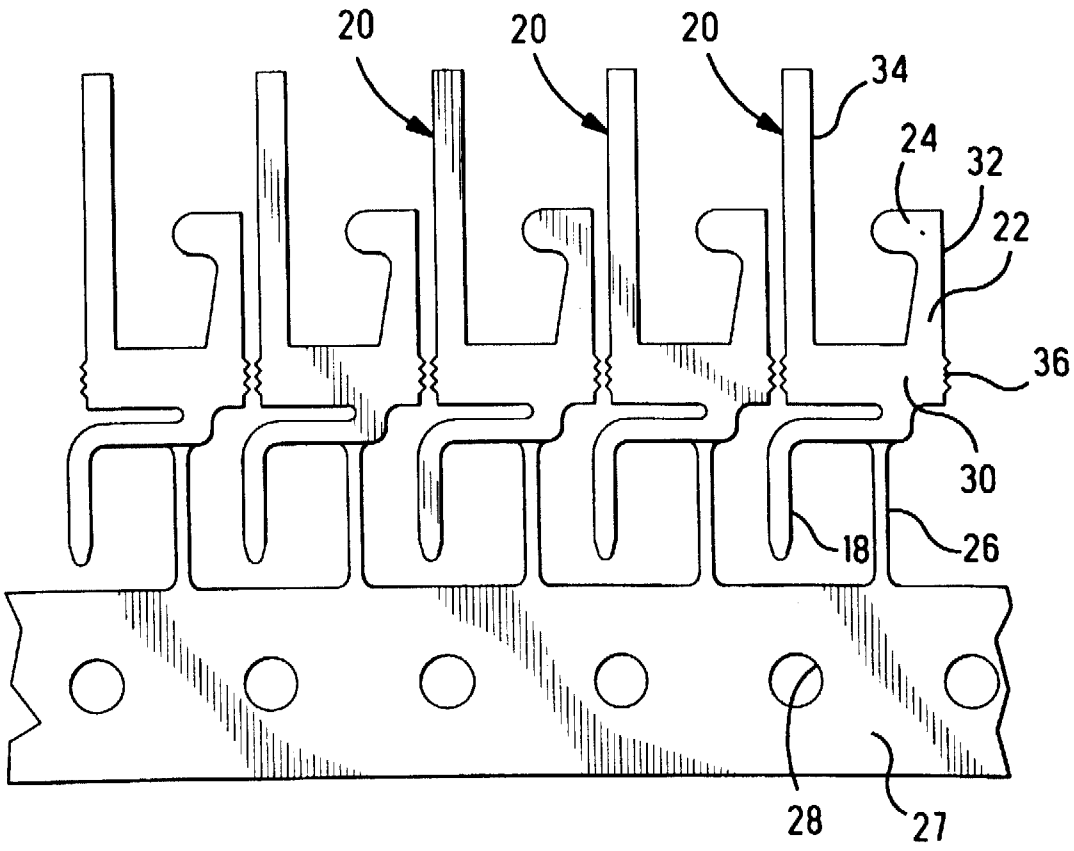
FIG. 2 shows a material strip after being stamped to produce initial profiles of contacts according to the invention.
Figure 3:
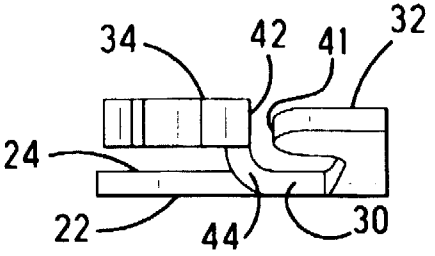
FIG. 3 is a top view of a contact after final forming according to the invention.

The contacts 15 are made from a sheet of electrically conductive material which is stamped or severed to remove selected portions of the material. FIG. 2 shows a strip of contacts after stamping but prior to bending. A material sheet has been stamped to form a row of the contact bodies 20 each of which has a profile defined by a severed peripheral edge extending through a thickness of the material. The body of each contact has opposite major surfaces 22, 24 which are defined by the major surfaces of the material from which it is produced. The contact bodies 20 are attached by webs 26 to a carrier strip 27 having apertures 28 that are engageable by a feed mechanism of an insertion machine that will install the contacts into the connector housing.

Each of the contact bodies has a base portion 30, a first arm 32, and a second arm 34, along with the previously discussed solder tail lead 18. In this stage of formation, the arms 32, 34 are aligned in a common plane which is also the plane of the base portion 30 and which coincides with the plane of the material from which the contact body is produced.

The base portion 30 preferably includes a retention device which is adapted to cooperate with the connector housing to provide a means for retaining the contact in the connector housing. The retention device may be, for example, barbed edges 36 which can engage in walls of a cavity in the housing. Alternatively, the retention device may include one or more lances or spikes which are engageable in walls of the housing, or the base portion may be adapted for an interference fit in a cavity in the housing, all of these retention methods being known in the art.

In a subsequent operation the contact bodies are bent and at least one of the first and second arms is moved out of the plane of the sheet material. For simplicity, FIGS. 3–6 illustrate a single contact body 20 which has been bent into a final configuration. However, it should be understood that the contact bodies remain attached to the carrier strip 27 while the bending is performed so that the contact bodies can be subsequently gang-loaded into the connector housing. This bending may involve twisting the contact bodies about their respective webs 26 which are connected to the carrier strip.

With reference to FIGS. 3–6, first and second arms 32, 34 are arranged to engage respective opposite sides of a circuit card which is installed therebetween. The first arm 32 is arranged to have a contact surface 41 along a peripheral edge of the contact body. The second arm 34 is arranged to have a contact surface 42 on the major surface 24 of the body. The base portion 30 has a right angle bend 44 which relocates the arms 32, 34 out of a common plane. Further, the first arm 32 has a bend 46 which inclines the first arm with respect to the base portion so that the contact surface 41 on the peripheral edge of the first arm is on the same contact centerline as the contact surface 42 of the second arm. This configuration is operative for use with a conventional SIMM daughtercard wherein contact pads which are mutually opposed on opposite sides of the card are electrically connected to a same circuit path on the card. However, the configuration of the contact arms is dictated by relative positions of the contact pads on the daughtercard which will be received between the arms.

Figure 5:
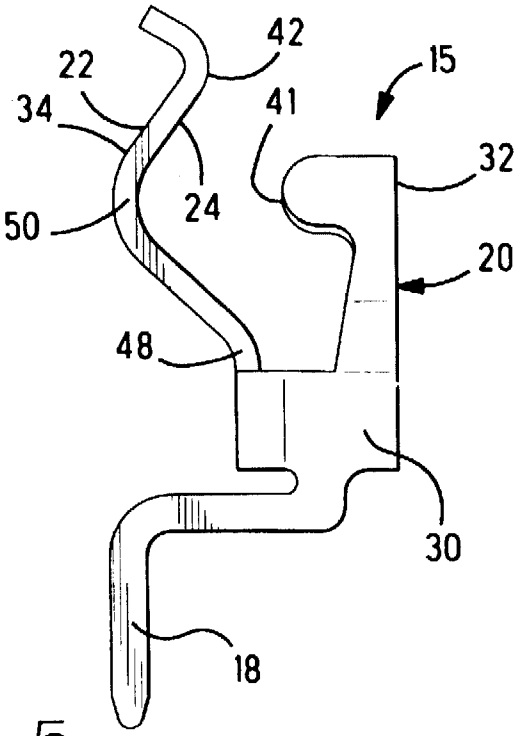
FIG. 5 is a side view of the contact.
Figure 4:
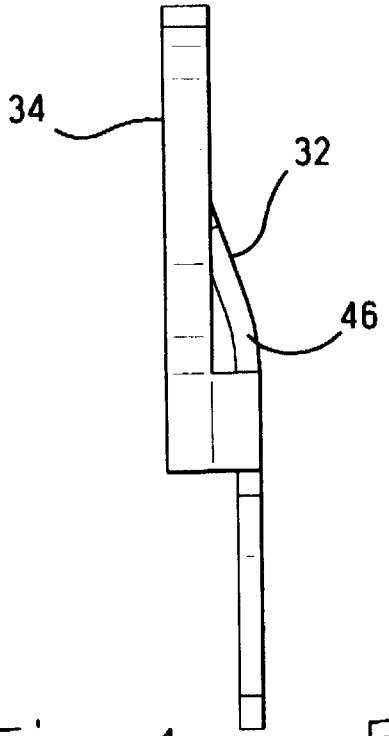
FIG. 4 is a rear view of the contact.
Figure 6:
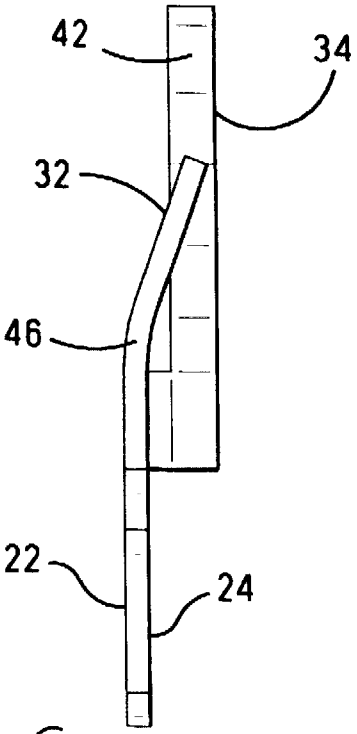
FIG. 6 is a front view of the contact.

The illustrated contact is designed for use in a cam-in socket wherein a daughtercard is initially inserted in a first orientation and is then pivoted toward the second arm 34 until reaching a second orientation, thereby becoming vertical with respect to the contact shown in FIG. 5. This pivoting causes significant deflection of the second arm 34. The second arm may be formed with bends such as lower bend 48 and upper bend 50 to provide desired spring characteristics which will generate a desired normal force on the circuit card when the card is secured in the second orientation.

The invention provides contacts which can be stamped from sheet material on relatively close centerlines with a relatively simple die, thereby conserving material and helping to reduce costs. The contacts are formed into a final configuration while attached to a carrier strip. The contacts are formed so as to be gang-loadable into an connector housing, thereby permitting insertion of a plurality of contacts into the housing during a single insertion stroke.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1. An electrical contact comprising:

an electrically conductive body which is made from sheet material, the body having opposite major surfaces and a peripheral edge defined by a thickness of the sheet material, the body having a base portion and first and second arms which extend upwardly from the base portion, each of the first and second arms having a contact surface arranged to engage a respective opposite side of a circuit card which is inserted between the arms, the base portion having a bend which relocates the arms from a common plane such that the contact surface of the first arm is defined on the peripheral edge of the body, and the contact surface of the second arm is defined on one of the major surfaces of the body.

2. The electrical contact of claim 1, wherein the major surfaces of the first arm are arranged perpendicular to the major surfaces of the second arm.

3. The electrical contact of claim 1, wherein a plane of the first arm is inclined with respect to a plane of the base portion.

4. A method of making an electrical contact comprising the steps of:

providing a sheet of electrically conductive material;

severing the sheet to form a contact body having a peripheral edge extending between opposite major surfaces;

forming the contact body with a base portion and first and second contact arms which extend upwardly from the base portion; and bending the base portion such that the first contact arm has a contact surface on a peripheral edge of the body, the second contact arm has a contact surface on one of the major surfaces of the body, and the contact surfaces are arranged to engage respective opposite sides of a circuit card which is inserted between the arms.

5. An electrical connector comprising:

a dielectric housing having a card-receiving slot, the housing holding a plurality of contacts which are arrayed along the slot for electrically connecting with circuit paths on a circuit card which is inserted into the slot, each of the contacts including:

an electrically conductive body which is made from sheet material, the body having opposite major surfaces and a peripheral edge defined by a thickness of the sheet material, the body having a base portion and first and second arms which extend upwardly from the base portion, each of the first and second arms having a contact surface arranged to engage a respective opposite side of the circuit card which is inserted into the slot, the base portion having a bend which relocates the arms from a common plane such that the contact surface of the first arm is defined on the peripheral edge of the body, and the contact surface of the second arm is defined on one of the major surfaces of the body.

6. The electrical connector of claim 5, wherein the major surfaces of the first arm are arranged perpendicular to the major surfaces of the second arm.

7. The electrical connector of claim 5, wherein a plane of the first arm is inclined with respect to a plane of the base portion.

* * * * *